United States Patent [19]

Huang

[11] 4,411,029

[45] Oct. 25, 1983

[54] CONTROL DEVICE FOR THE WATER TANK OF A FLUSH TOILET

[75] Inventor: Jiunn-Cherng Huang, Taipei Hsien, Taiwan

[73] Assignee: Sin Sui Lai, Taiwan

[21] Appl. No.: 330,436

[22] Filed: Dec. 14, 1981

[51] Int. Cl.[3] ..... E03D 1/34; E03D 1/14; E03D 3/12

[52] U.S. Cl. ..... 4/324; 4/325; 4/395; 4/405; 4/394

[58] Field of Search ..... 4/324, 325, 249, 415, 4/326, 378, 405, 395, 360, 387, 404, 413, 407, 410, 394

[56] References Cited

U.S. PATENT DOCUMENTS

| | | | |
|---|---|---|---|
| 2,532,977 | 12/1950 | White | 4/325 |
| 3,487,476 | 1/1970 | Stiarn et al. | 4/326 |
| 3,538,519 | 11/1970 | Waisz | 4/325 |
| 3,574,866 | 4/1971 | Sievers | 4/325 |
| 3,775,778 | 12/1973 | Lee | 4/325 |
| 3,790,968 | 2/1974 | Pfeifer | 4/324 X |
| 3,831,204 | 8/1974 | Cook | 4/324 X |
| 3,994,029 | 11/1976 | Badders | 4/407 X |
| 4,014,050 | 3/1977 | Goldsworthy | 4/325 |
| 4,135,262 | 1/1979 | Overbey | 4/325 |
| 4,275,471 | 6/1981 | Becker | 4/324 X |

*Primary Examiner*—Henry K. Artis

*Attorney, Agent, or Firm*—LeBlanc, Nolan, Shur & Nies

[57] ABSTRACT

A controlling device for the water-tank of a flush toilet comprising two handles on the water-tank whereby a high or low level is optionally determined, and whose controlling elements are all fitted to the handle assemblies and are independent of a hydraulic backing gate. The invention results in ease of assembling and repair, and also reduced effort for operation of the handles as well as reduced cost for modifications of a conventional water-tank.

4 Claims, 4 Drawing Figures

CONTROL DEVICE FOR THE WATER TANK OF A FLUSH TOILET

BACKGROUND OF THE INVENTION

The invention relates to a controlling device for the water-tank of a flush toilet. The conventional two-level controllable water-tank, the controlling components of which are all fitted on the hydraulic backing gate, has the disadvantage of being extremely laborious to operate because of larger force is required to be applied to the handle to open the hydraulic backing gate. Thus there often occurs a malfunction of a broken chain and the floating ball for adjusting the high and low water levels and its fasteners often influence the normal operation of the feeding float and the feeding velocity. In addition, the modification of controlling devices of these water-tanks is difficult and can only be completed by special tools and professional persons, making the manufacturing and modification cost too high to be easily and widely accepted by the market.

SUMMARY OF THE INVENTION

The primary object of the invention is to eliminate disadvantages of a conventional water-tank for a flush toilet and to provide an improved two-level controlling device of a water-tank, in which, no floating ball and its fasteners are included to the hydraulic backing gate, so when the handle is pressed the operation is very light, convenient and force-saving; furthermore, the floating ball is independent of the hydraulic backing gate in action, the feeding velocity and the feeding float can both work self-independently without mutual entanglements.

Another object of the invention is to provide a two-level controlling device of the water-tank for a flush toilet, the high and low position of whose two water levels can all be adjusted optionally by the user himself to meet the requirements of using occasions to fulfill the purpose of saving water most economically and effectively.

A further object of the invention is to provide a two-level controlling device of the water-tank for a flush toilet, which, during installation for using it, does not involve members of a hydraulic backing gate, and therefore it can be assembled easily by laymen without any special tools and specialized technical workers.

BRIEF DESCRIPTION OF THE DRAWINGS

These and other objects of the invention will be more obvious from the following description taken in connection with the accompanying drawings, wherein.

DETAILED DESCRIPTION OF THE DRAWINGS

Figure 1:
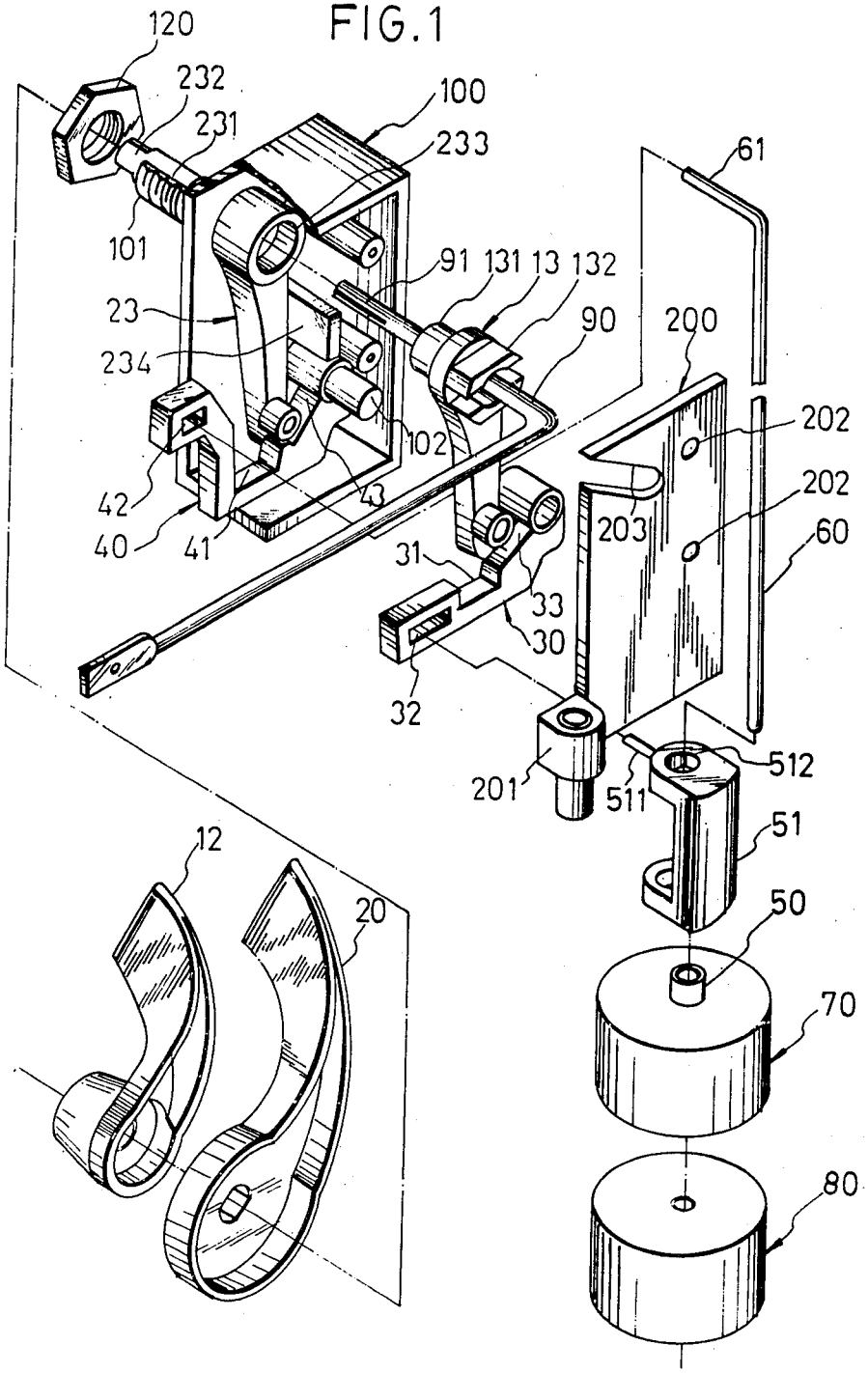
FIG. 1 is an exploded perspective view of the present invention.
Figure 3:
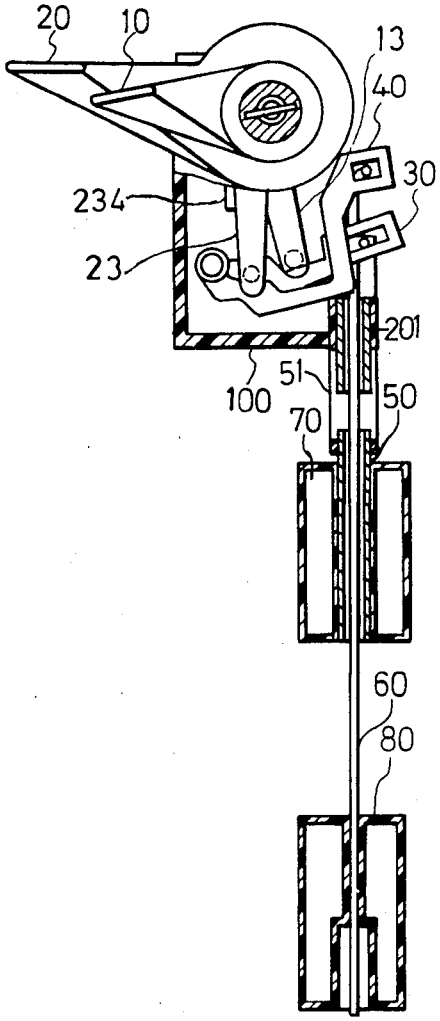
FIG. 3 is showing in a manner of using high water-level by pressing a small handle of the present invention.

As shown in FIGS. 1 and 3 the two-level controlling device of a water-tank according to the present invention comprises a housing 100, cranks 13, 23, small handle 10, large handle 20, cradle members 30, 40, L-shaped pulling rod 90, small diameter connecting rod 60, large diameter connecting rod 50, high-level float 70, and low-level float 80. The housing 100 is a rectangular body, the front of which has a hollow threaded tube 101, capable of extending through the water-tank's handle port-hole and being fixed to the tank with a nut 120, the rear of which has a cover plate 200, at one of its lower corners, a shaft tube 201 being provided, at the back of which are two fixing holes 202 for fixing it to the housing 100 with screws (not shown), and on its top corner of which an inclined slot 203 is provided for the insertion of the rod 90 described hereinafter. The crank 23 provides a crankshaft tube 231 at its top extending through the tube 101 of the housing, and projecting out of the tube 101 being a joint end 232 of the shaft tube 231 which can be caught with an embedding hole 21 of the large handle 20, and the shaft tube 131 of crank 13 being inserted into a rear concave seat 233 of the crank 23; the short arm of pulling rod 90 being extended out of the water-tank through shaft tubes 131 and 231. A split slot 91 at the front end of said short arm 90 is just capable of being caught with the embedding hole 11 of the small handle 10, and the long arm of the rod 90 drawing a falling water head with a rope or chain (not shown). Split projections 132 at the rear upper end of shaft tube of crank 13 are used to catch the pulling rod 90 so that the crank 13 may be operatively connected with the rod 90. At the lower part inside the housing 100 is provided a projecting rod 102 as a pivot for cradle members 40 and 30, said two members at inner side having each an inclined catching portions 43 and 33 and in the middle a concave portions 41 and 31 which are engaged with the lower end shafts 235 and 135 of said cranks 23 and 13, respectively, and at the tail end a slot holes 42 and 32 separated in high and low position. In this manner, for simplifying te construction of the invention, the large diameter connecting rod 50 is a hollow tube and caught into a rectangular hole 32 of the cradle member 30 with a catching end 511 of the U-shaped pivot member 51 in which the lower end of member 51 is inserted tightly to the upper end of said rod 50, and its lower end is in turn suspending the high water-level float 70; in the same manner, the upper end 61 of connecting rod 60 is caught into a rectangular hole 42, while its lower end thereof is extending through a shaft hole 512 of the U-shaped pivot member 51, to the connecting rod 50, and suspending a low water-level float 80. It is to be pointed out that, for the purpose of smooth operation, the lower end shafts 235 and 135 are further inserted into slip rings 236 and 136, respectively.

When the level of the water-tank is at full capacity, the flotation forces acts on the inclined catching portions 33 and 43 of cradle members 30 and 40, said two floats 70 and 80 running against respectively the corresponding cranks 13 and 23, making the handles 10 and 20 to appear in a normal state as shown in FIG. 1.

It should be understood that, when the present invention is used for a installation of conventional water-tank, the floating ball on the falling water head should be removed first, then the threaded tube 101 of the housing 100 is extended out of the tank through the handle port hole, and the lower end of pulling rod 90 is drawn together with a robe or chain to the falling water head.

Figure 4:
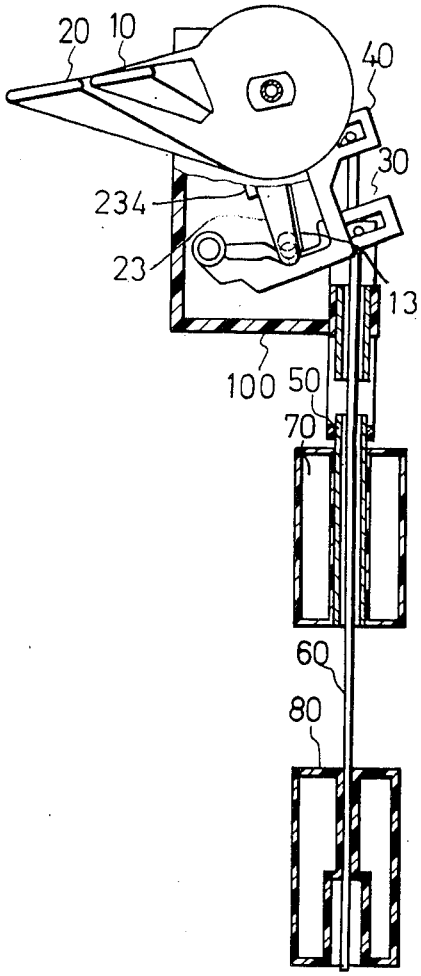
FIG. 4 is showing in a manner of using low water-level by pressing a large handle of the present invention.

During use, press downward the small handle 10, rendering the crank 13 and the pulling rod 90 to rotate a certain angle counter-clockwise, as shown in FIG. 3, so that the portion caught by the crank 13 and the cradle member 30 turns into the concave portion 31 from the inclined portion 33, then the float 70 moves upward, at that time, a hydraulic gate connected to the pulling rod 90 by means of a chain is opened to start flushing, until the flotation force of the float 70 is lost, all the components mentioned above return to their original positions, the flushing will be stopped. Similarly, when the large handle 20 is pressed downward, as shown in FIG. 4, due o the driving of the projection portion 234 of the crank 23, the crank 13, small handle 10 and the pulling rod 90 are also altogether turning a certain angle counter-clockwise, and the floats 70, 80 are not run against any more and both raise upward their respective cradle, making the cranks 13 and 23 caught respectively into the concave portions 31 and 41 of cradle members 30 and 40, so, after the flotation force of float 80 is lost the components mentioned above return to their original positions and the flush will be stopped.

As mentioned above, floats 70 and 80 are movably mounted on the connecting rods 50 and 60, respectively, the height of either one of the floats may be optionally adjusted by the user in order to meet the requirements of special uses to achieve the purpose of saving water.

It will be clear that there may be some deviations in structure from the structure shown in the drawings, within the scope of the appended claims. In particular, as stated, the controlling device may only have one crank, one cradle member, one connecting rod and its associated float, if it is to be combined (or modified) with the already existing water-level controlling device in some other way.

I claim:

1. A two-level controlling device for the water-tank of a flush toilet comprising:

a housing having a threaded tube mounted to the water-tank;

at least one crank means extending through the housing to outside of the tank and embedded with a handle means;

a pulling rod means having its short arm caught into the rear of said at least one crank means and the front end of said short arm extending through shaft tube of said crank means and the housing to the outside of the tank and embedded with a handle means, and the long arm of said rod means connecting to a falling water head through a flexible member;

at least one cradle means provided inside said housing, and being kept in a position of engaging with a lower end of said crank means;

a connecting means having its upper portion movably connected to the outer end of said cradle means;

a floating means being movably connected to the lower portion of said connecting means; and when said handle means being pressed, rendering said crank means, said rod means and said cradle means to rotate a certain angle counter-clockwise, the floating means moving upward; said falling water head is thus opened to start flushing, until the flotation force of said floating means is lost.

2. A controlling device according to claim 1 wherein on the projecting shaft in contact with cradle means of the lower end of said crank means is rotatably mounted a slide-wheel.

3. A controlling device according to claim 1 wherein said connecting rod means is overslipped with a same shaft and has the shaft tube at the lower end cover plate of the housing as a support point.

4. A controlling device according to claim 1 wherein the height of either one of said floating means is to be adjusted.

* * * * *

UNITED STATES PATENT AND TRADEMARK OFFICE

CERTIFICATE OF CORRECTION

PATENT NO. : 4,411,029

DATED : October 25, 1983

INVENTOR(S) : Jiunn-Cherng Huang

It is certified that error appears in the above-identified patent and that said Letters Patent is hereby corrected as shown below:

Column 2, line 36, change "te" to --the--.

Column 2, line 52, change "forces" to --force--.

Figure 2:
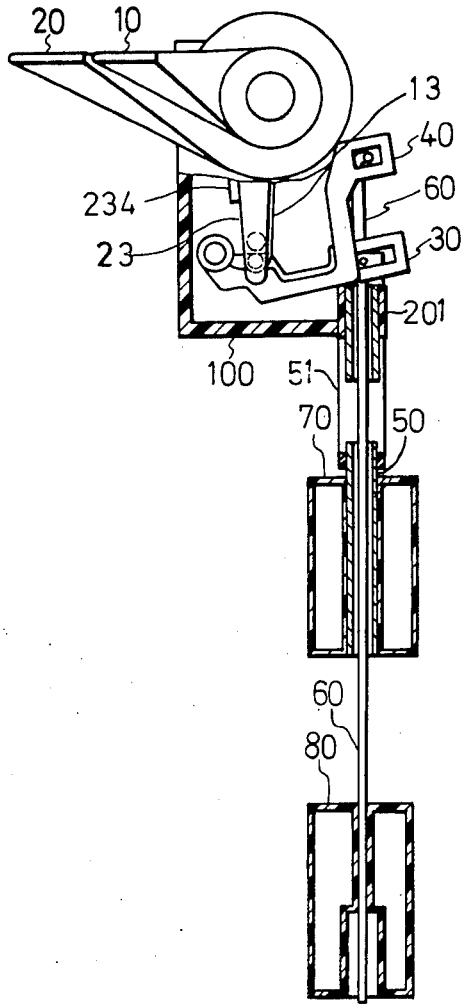
FIG. 2 is a front view of the present invention, showing that it is in normal conditions and ready for use.

Column 2, line 56, change "FIG. 1" to --FIG. 2--

Signed and Sealed this

*Twenty-eighth* Day of *February 1984*

[SEAL]

*Attest:*

GERALD J. MOSSINGHOFF

*Attesting Officer*

*Commissioner of Patents and Trademarks*